US008851317B2

(12) United States Patent
Juhere

(10) Patent No.: US 8,851,317 B2
(45) Date of Patent: Oct. 7, 2014

(54) EFFLUENT FILTRATION TANK

(75) Inventor: Yannick Juhere, Cancale (FR)

(73) Assignee: Maya Group, Chateauneuf d'ille et Vilaine (FR)

( * ) Notice: Subject to any disclaimer, the term of this patent is extended or adjusted under 35 U.S.C. 154(b) by 720 days.

(21) Appl. No.: 12/745,854

(22) PCT Filed: Dec. 5, 2008

(86) PCT No.: PCT/EP2008/066922

§ 371 (c)(1),
(2), (4) Date: Jun. 24, 2010

(87) PCT Pub. No.: WO2009/071682

PCT Pub. Date: Jun. 11, 2009

(65) Prior Publication Data

US 2010/0270220 A1 Oct. 28, 2010

(30) Foreign Application Priority Data

Dec. 7, 2007 (FR) ..... 07 08549

(51) Int. Cl.

| | |
|---|---|
| ***A24F 19/00*** | (2006.01) |
| ***B65D 1/42*** | (2006.01) |
| ***B65G 5/00*** | (2006.01) |
| ***B65D 88/06*** | (2006.01) |
| ***B65D 88/76*** | (2006.01) |

(52) U.S. Cl.

CPC ..... *B65D 88/06* (2013.01); *B65D 88/76* (2013.01)

USPC ..... 220/567.1; 220/647; 405/53

(58) Field of Classification Search

CPC ..... B65D 88/76; B65D 88/06; B65D 90/08; B65D 88/128; B65D 90/028

USPC ..... 220/626, 675, 687, 4.04, 4.11, 4.16, 220/4.17, 475, 567.1, 646, 647, 648, 220/651–654, 639, 642, 643, 645; 210/170, 210/170.08, 261, 532, 62; 405/53; 588/250

See application file for complete search history.

(56) References Cited

U.S. PATENT DOCUMENTS

| | | | | |
|---|---|---|---|---|
| 3,097,166 | A * | 7/1963 | Monson | 210/170.08 |
| 3,784,012 | A * | 1/1974 | Carlson | 210/170.08 |
| 4,840,282 | A * | 6/1989 | Gerhard | 220/1.5 |

(Continued)

FOREIGN PATENT DOCUMENTS

| | | |
|---|---|---|
| DE | 202006011483 U1 | 9/2006 |
| FR | 2798913 | 3/2001 |

*Primary Examiner* — Bryon Gehman
*Assistant Examiner* — Shawn M Braden
(74) *Attorney, Agent, or Firm* — Thorpe North & Western LLP

(57) ABSTRACT

A filtration tank intended to be buried and for containing wastewater in particular, the tank (100) comprising a casing (110) having an upper part (200) and a lower part (300), the tank being provided with voussoirs (610, 610') for reinforcing the structure of the casing (110) so that it can withstand the pressure exerted by the surrounding material when the tank (100) is buried and is not completely filled. The voussoirs (610, 610') bearing against the upper part (200) and in that the tank (100) incorporates means (650d, 670) for absorbing the supporting forces of the voussoirs (610, 610') so as to transfer said forces onto the bottom (310) of said tank. A tank is thus obtained which withstands being buried without deforming even though it may be only partially filled.

24 Claims, 15 Drawing Sheets

(56) References Cited

U.S. PATENT DOCUMENTS

Figure 1:
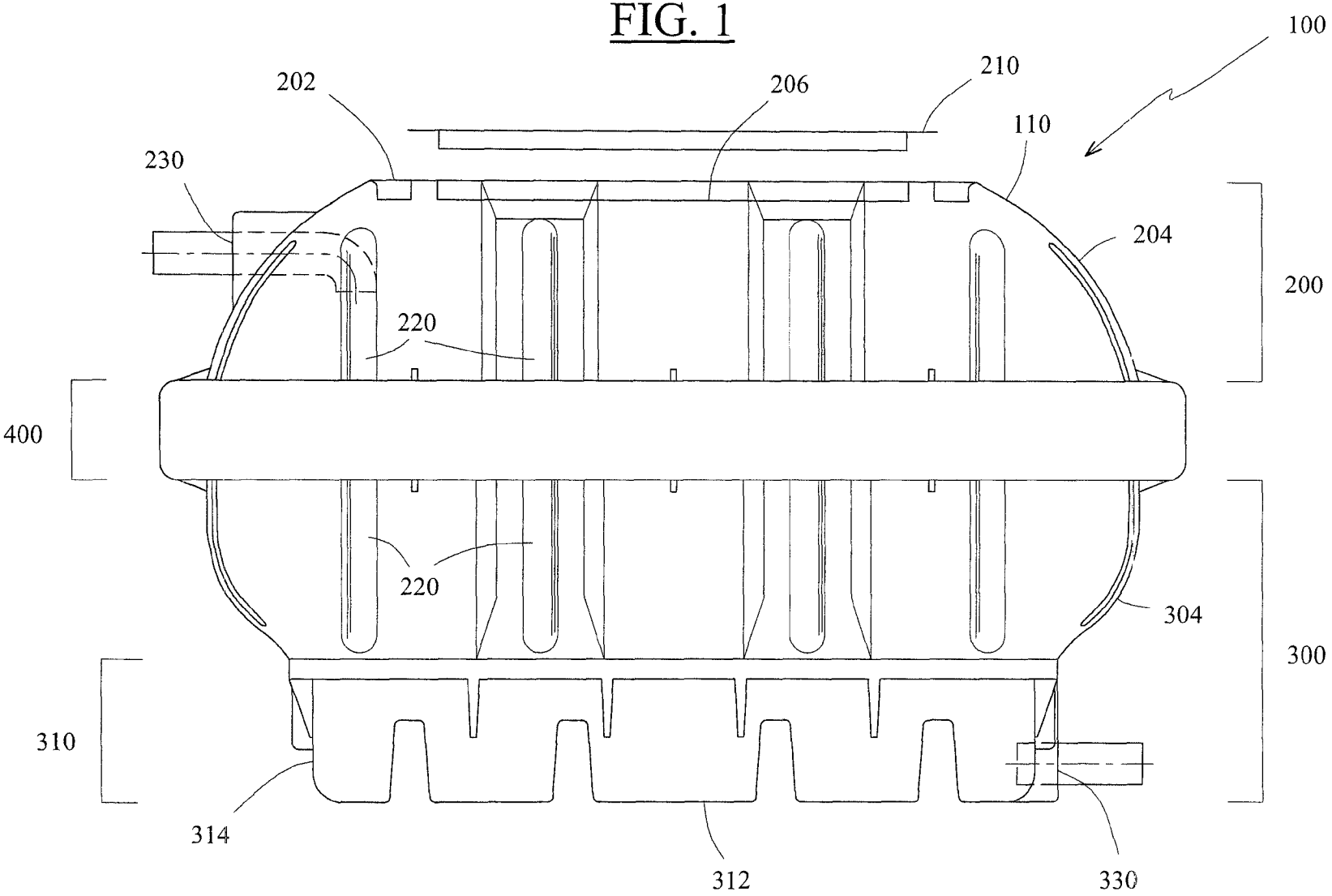

| | | | | | |
|---|---|---|---|---|---|
| 5,121,852 | A * | 6/1992 | Wilkes | 220/203.12 |
| 5,193,714 | A * | 3/1993 | Carey | 220/592 |
| 5,547,589 | A * | 8/1996 | Carroll, II | 210/747.1 |
| 5,590,803 | A * | 1/1997 | Kaempen | 220/560.03 |
| 5,816,424 | A * | 10/1998 | Cannan et al. | 220/4.12 |
| 5,938,065 | A * | 8/1999 | De Vivo et al. | 220/562 |
| 7,854,338 | B2 * | 12/2010 | Graf | 220/4.06 |
| 2001/0019026 | A1 * | 9/2001 | Berg et al. | 210/170 |
| 2004/0188447 | A1 * | 9/2004 | Bolzer | 220/653 |

* cited by examiner 600
500
610
650a
650b
650c
650d
630
510
510a
510b
530
530a
530b 531
532
534
530

650b
A
535
531b
536
533
538
534
532
533
535
A
538
536
650b
A
531a 531b
536
535
533
532
533
535
536
531a

FIG. 9a
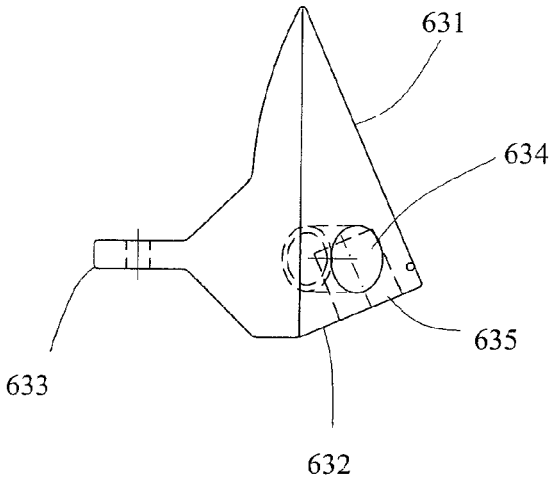
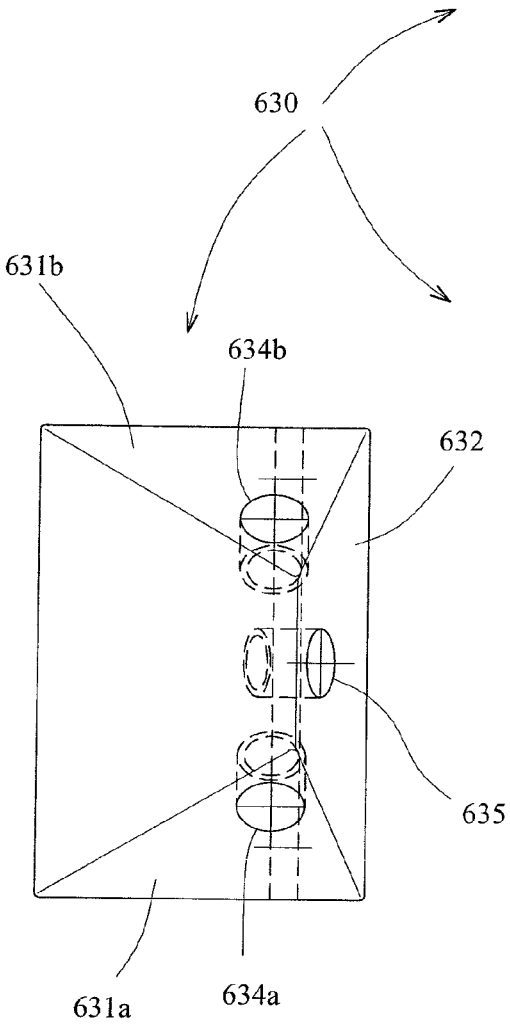
FIG. 9c
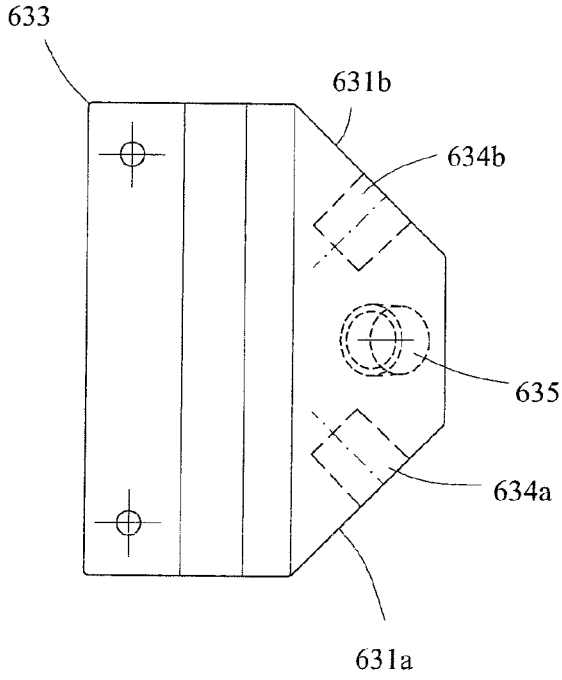
FIG. 9b

EFFLUENT FILTRATION TANK

This is a National Stage of International Application No. PCT/EP2008/066922.

The present invention relates to a tank intended to be buried and for containing wastewater in particular.

The intended applications concern the fields of construction and public works, agriculture and industry.

A tank for such an application is often made from polyester or medium-density polyethylene (MDPE). Such a tank does not effectively withstand being buried since it can deform due to a lack of rigidity if it is buried when it is not completely filled.

The object of the invention is therefore to propose a tank which withstands the pressure that the material surrounding the tank may exert once the latter has been buried.

To this end, there is proposed a tank intended to be buried and for containing wastewater in particular, the tank comprising a casing having an upper part and a lower part, the tank being provided internally with a means for reinforcing the structure of the casing so that it can withstand the pressure exerted by the surrounding material when the tank is buried and is not completely filled; according to the invention, the reinforcing means comprises voussoirs bearing against the upper part and the tank incorporates means for absorbing the supporting forces of the voussoirs so as to transfer said forces onto the bottom of said tank.

A tank is thus obtained which withstands being buried without deforming even though it may be only partially filled.

According to an additional feature of the invention, each voussoir comprises a wall in the shape of an arch portion capable of mating internally with a rounded wall of the upper part, and the means for absorbing the forces consist of bars and tubes.

The bars and tubes transfer the forces to the bottom of the tank.

According to an additional feature of the invention, a gap separates the upper part and the lower part, and the reinforcing means comprises wedges, the voussoirs and the wedges being provided respectively with lugs which are inserted in the gap, at least some of the voussoirs and wedges being connected via connecting bars.

The voussoirs are secured to the casing and reinforce the upper part. The wedges are secured to the casing and reinforce the sides of the tank. The connecting bars transfer the forces which are applied externally to the casing by the surrounding material to other voussoirs and other wedges when the tank is buried.

According to an additional feature of the invention, the tank comprises in its bottom a permeable floor intended to support a means for filtering the liquid that may be introduced into said tank, the floor being connected to the voussoirs and to the wedges via connecting bars.

The floor absorbs the forces having a vertical component which are transmitted by the voussoirs and the wedges, so as to avoid any weakening of the tank when it is buried.

According to an additional feature of the invention, the floor is composed of a plurality of elements placed in a juxtaposed manner on the bottom and separate therefrom.

These floor elements allow the liquid filtered through the filtration means to flow towards the bottom of the tank.

According to an additional feature of the invention, the floor comprises two end elements placed one on each side of at least one intermediate element, the end element being provided with a boss in which there is formed a housing for receiving the end of a connecting bar, the intermediate element being provided respectively with two bosses in which there are formed two housings for receiving the ends of two connecting bars.

Each floor element withstands part of the load transferred either by voussoirs or by a wedge.

According to an additional feature of the invention, the wall in the shape of an arch portion is surmounted by a wall in the shape of a plate, the large length of which is arranged perpendicular to the median plane of the wall so as to support locally the rim of an access opening of the tank, the wall in the shape of an arch portion being prolonged, opposite the plate and in its dorsal part, by a lug able to be inserted in the gap provided between the upper part and the lower part of the casing, a first housing being formed in the wall, through its inner face, facing horizontally, so as to receive an end of a connecting bar, a second housing being formed in the wall, through its inner face, facing downwards, so as to receive an end of another connecting bar.

According to an additional feature of the invention, each wedge consists of a block delimited on one side by two lateral facets and one bottom facet which is intended to face downwards, and delimited on the other side by a lug able to be inserted in the gap provided between the upper part and the lower part of the casing, two housings being formed respectively in the two lateral facets so as to receive an end of a connecting bar, a third housing being formed in the bottom facet so as to receive an end of a third connecting bar.

According to an additional feature of the invention, the housings formed in the floor element and the second housing formed in the voussoir are connected respectively to vents which open outwards, the corresponding connecting bars being hollow so that the part located below the floor can be ventilated.

According to an additional feature of the invention, the housing formed in the floor element is connected to a vent which opens outwards, the connecting bar between the floor element and the wedge and the connecting bars between the wedge and the voussoir are hollow, and the housings formed in the wedge open outwards.

According to an additional feature of the invention, bridges are formed locally in the gap between the upper part and the lower part so as to reinforce the connection thereof and to laterally wedge the voussoirs and the wedges.

According to an additional feature of the invention, the tank is provided with an external peripheral belt intended to form a rigid connecting structure between the two parts.

According to an additional feature of the invention, the upper part, the lower part and the belt consist of one and the same continuous wall.

According to an additional feature of the invention, the belt is composed of a first semicircular loop which prolongs the wall of the upper part, a short straight portion which is prolonged by a second, larger semicircular loop, a straight portion, another semicircular loop, another short straight portion which is prolonged by a fourth semicircular loop which is connected to the wall of the lower part, the first loop and the fourth loop being separate so as to form the gap between the two parts.

This structure makes it possible to form a means for wedging the voussoirs and the wedges.

According to an additional feature of the invention, the reinforcing means comprises posts secured by their ends in housings respectively formed in the upper wall of the tank and in its bottom.

When the tank is lifted by its upper wall, the posts work in traction to join the upper wall and the bottom of the tank. When the tank is buried, the posts work in compression so that the tank can withstand the load of the surrounding material on its upper wall. This load is transferred by the posts to the bottom of the tank.

According to an additional feature of the invention, the reinforcing means comprises a beam secured to two opposite sides of the tank.

This beam provides increased resistance to weakening of the tank in its central part.

According to an additional feature of the invention, a plate protrudes downwards so as to be able to bear against the bottom of the tank in order to reinforce the structure thereof and to delimit two compartments in which two volumes of the filtration means can be placed, posts protrude from the beam in a direction opposite to the plate and the free ends of which are fixed to the upper wall so that the beam can join the upper wall and the bottom of the tank in order to make the latter more rigid.

According to an additional feature of the invention, each voussoir comprises two rectilinear profiles butted against the wall in the shape of an arch portion.

The voussoir laterally supports the upper wall of the tank. It is intended to be combined with a tank of relatively large capacity.

According to an additional feature of the invention, the tank is provided with an outlet orifice intended for evacuating the treated effluent to an authorised outfall.

This tank is suitable in particular for irrigating the ground with the aid of drains.

According to an additional feature of the invention, the bottom is perforated by a plurality of passages so as to enable the effluent to infiltrate, by gravity, the ground on which the tank rests.

This tank is suitable for infiltrating the ground directly with the filtered effluent, when the ground so permits, and according to the legislation in force.

According to an additional feature of the invention, the bottom consists of a component attached to the tank.

Depending on whether the bottom is or is not perforated, it is possible to construct a remote discharge tank or a tank providing direct infiltration of the ground.

According to an additional feature of the invention, the casing is made by a rotational moulding method.

According to an additional feature of the invention, the floor elements, the voussoirs, the wedges and the connecting bars are made by a rotational moulding method.

According to an additional feature of the invention, the rotational moulding method uses a starting material capable of forming a polyethylene foam.

Figure 2:
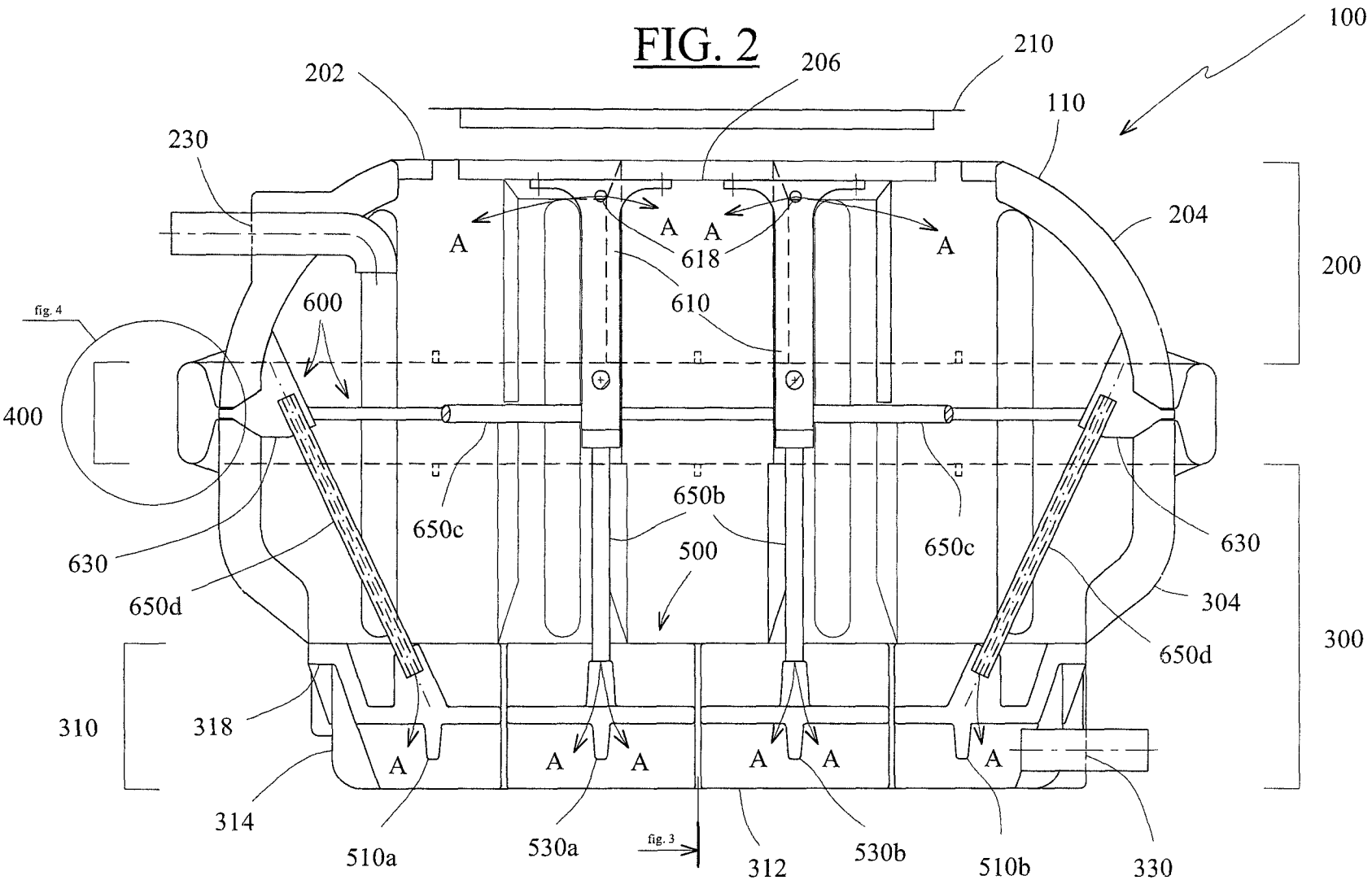
Figure 3:
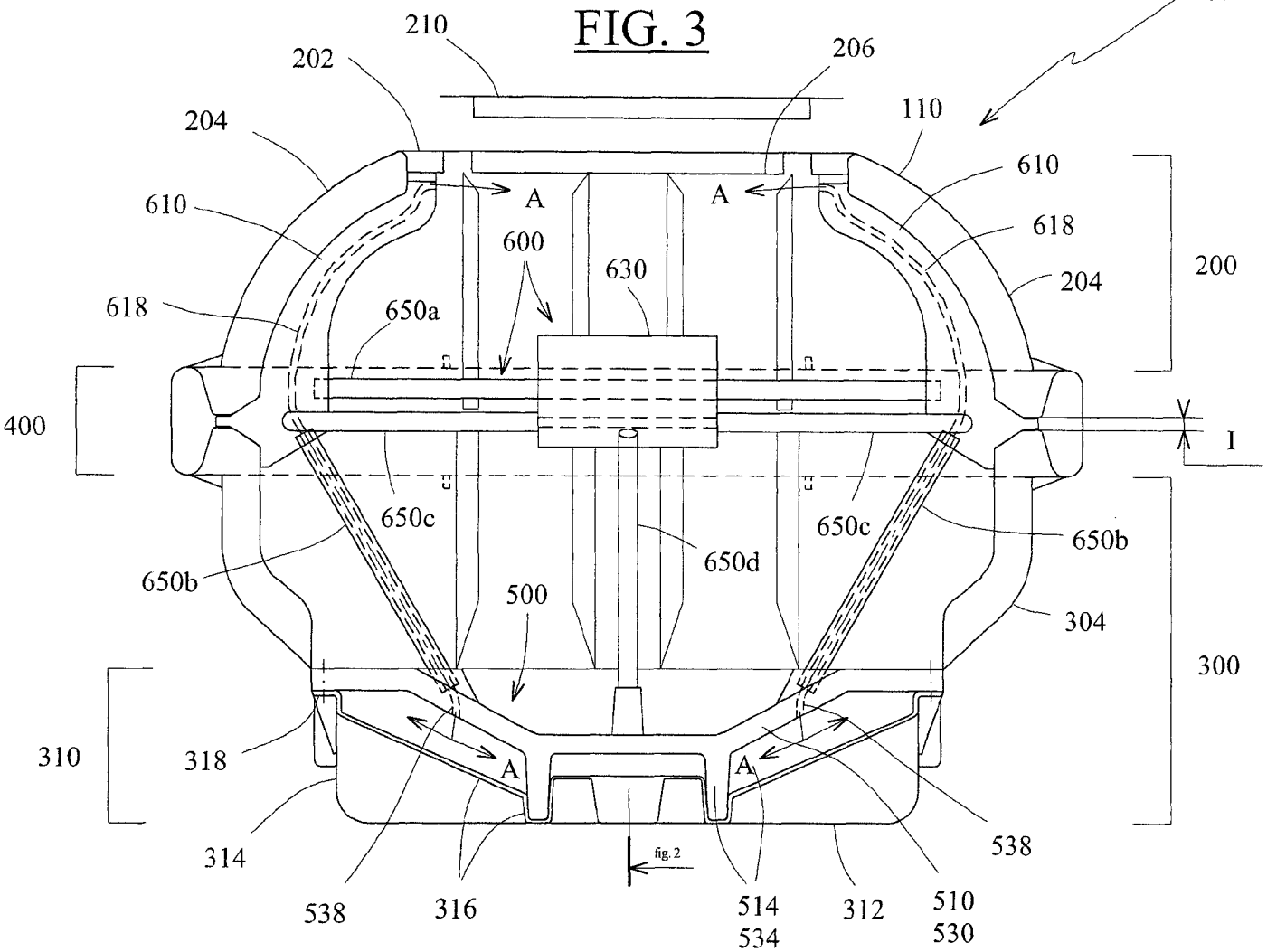
Figure 4:
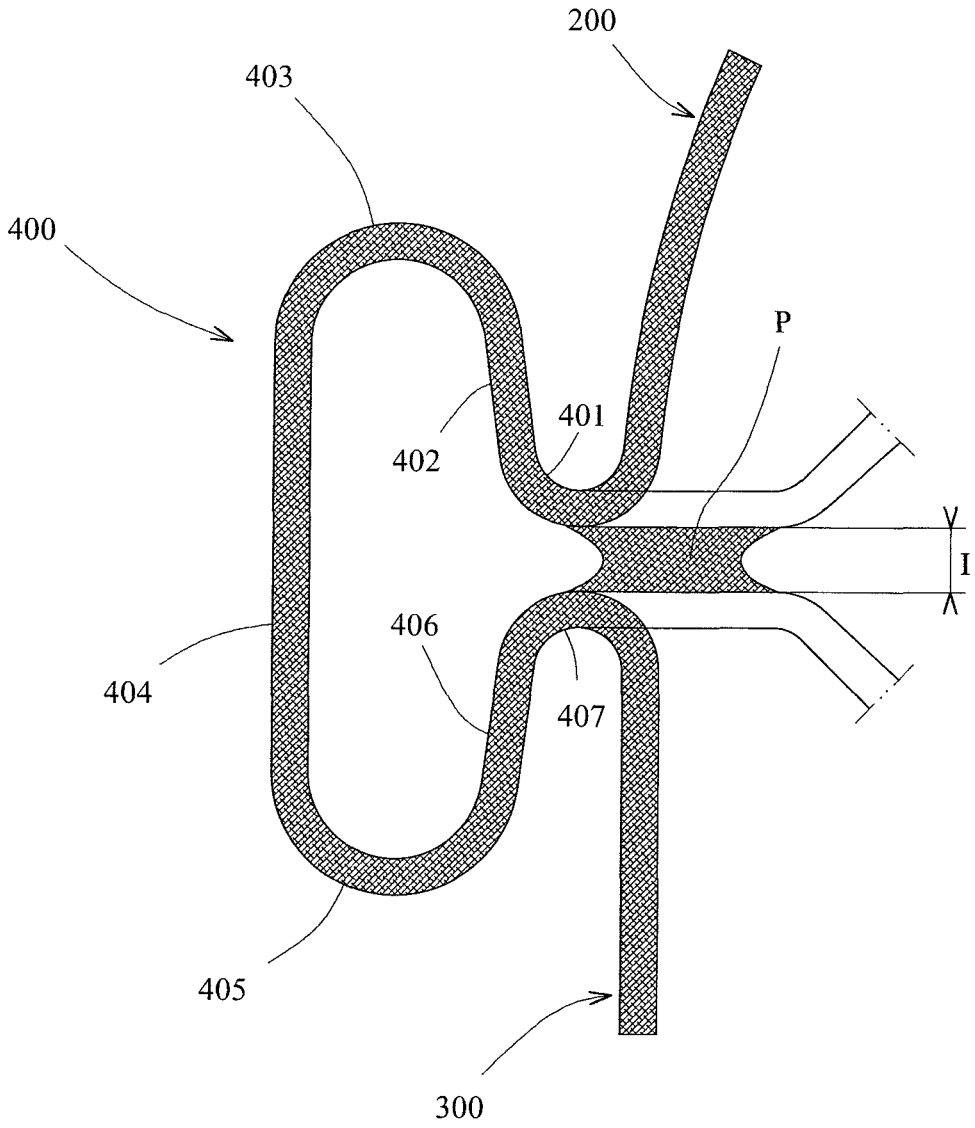
Figures 5A, 5B, 5C:
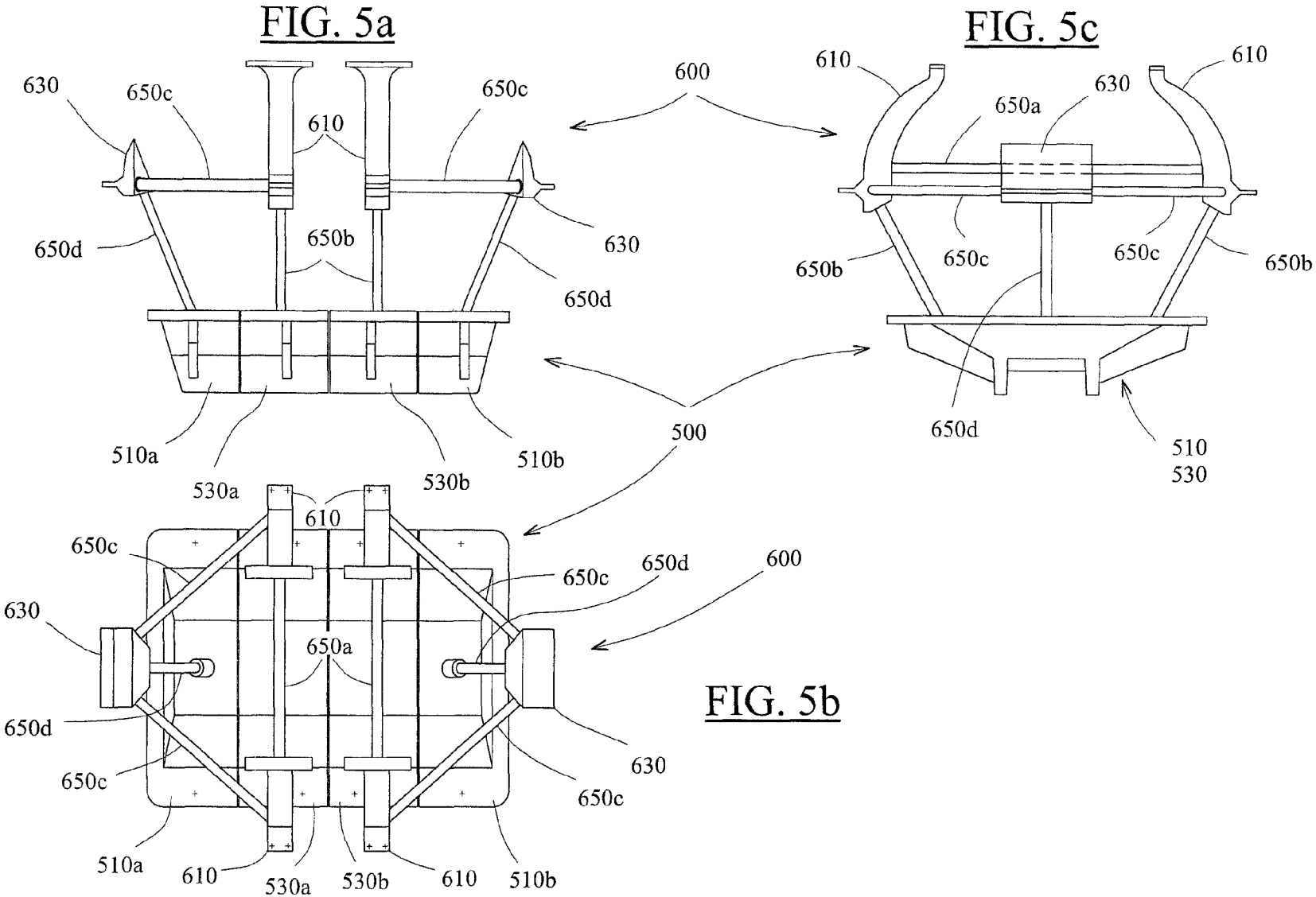
Figure 6C:
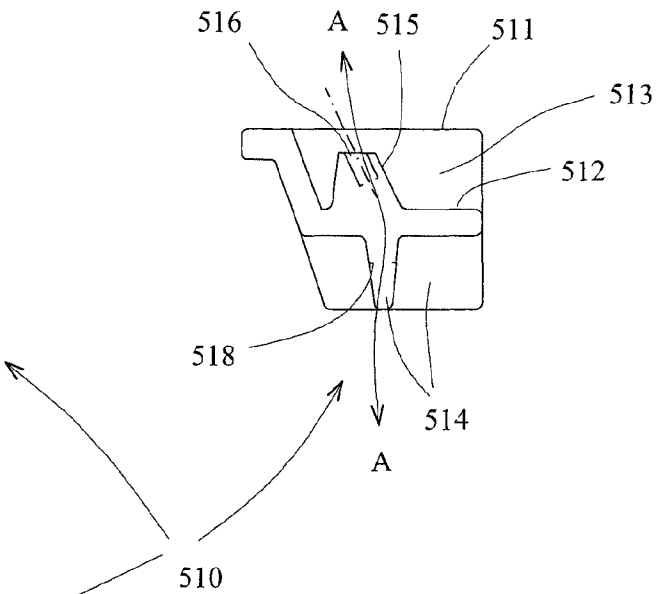
Figure 6A:
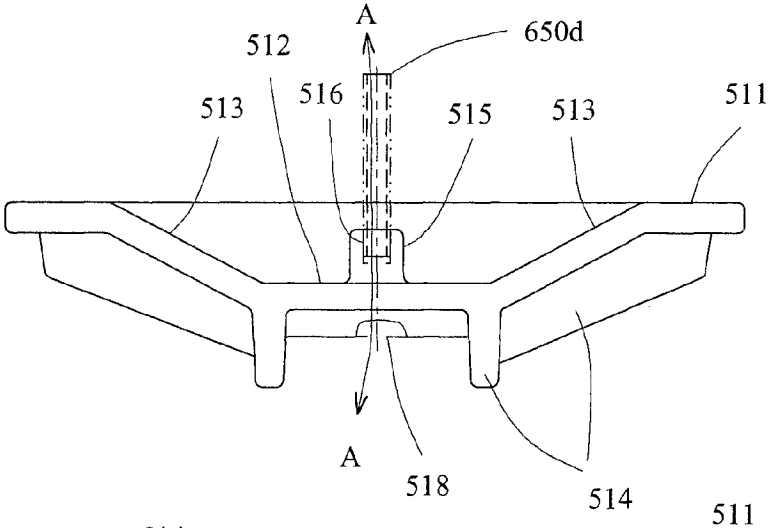
Figure 6B:
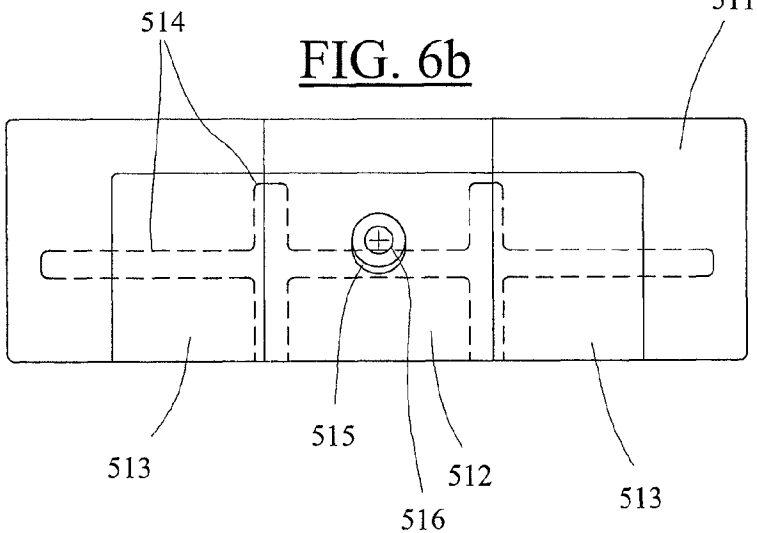
Figures 7A, 7B, 7C:
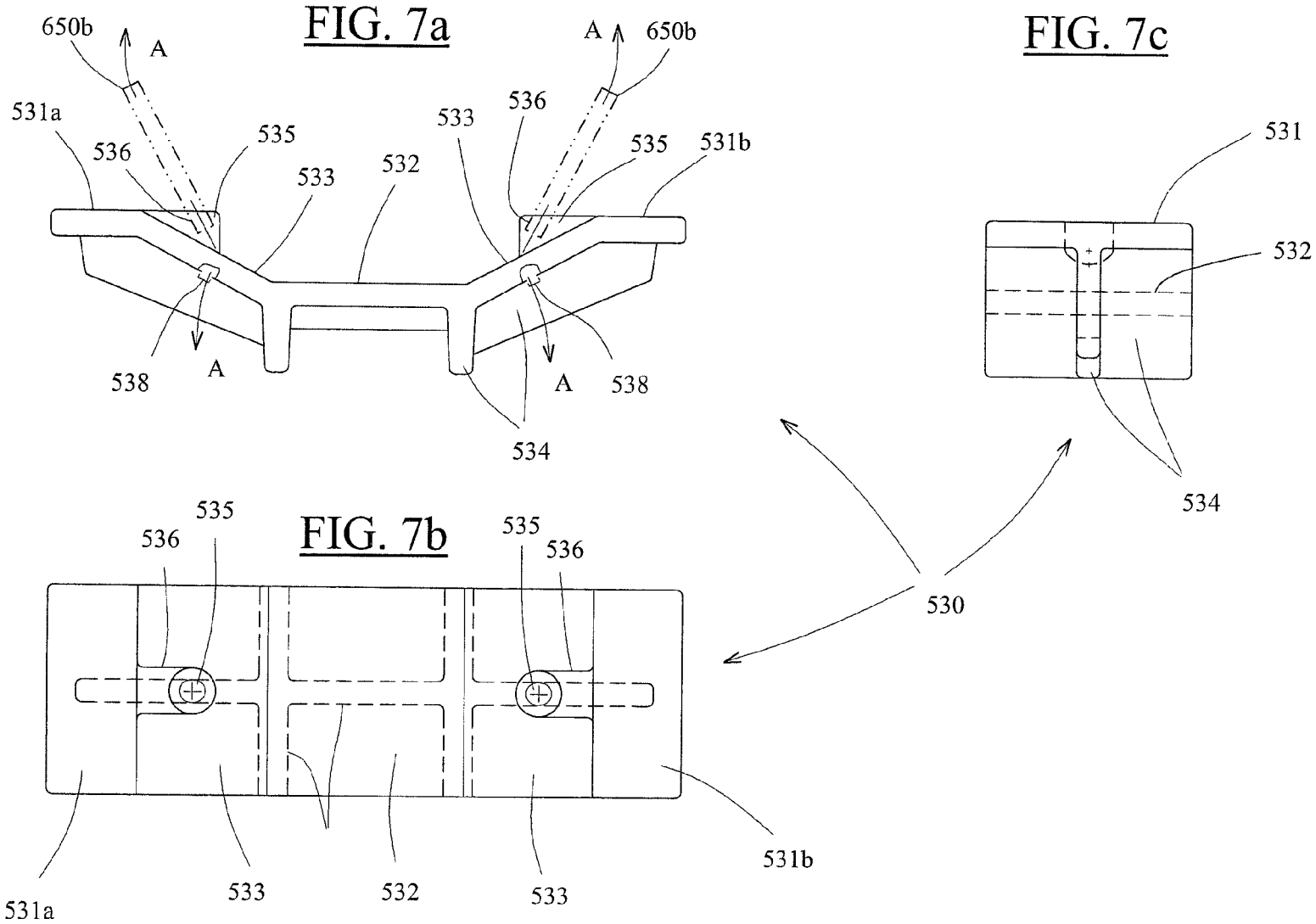
Figures 8A, 8B, 8C:
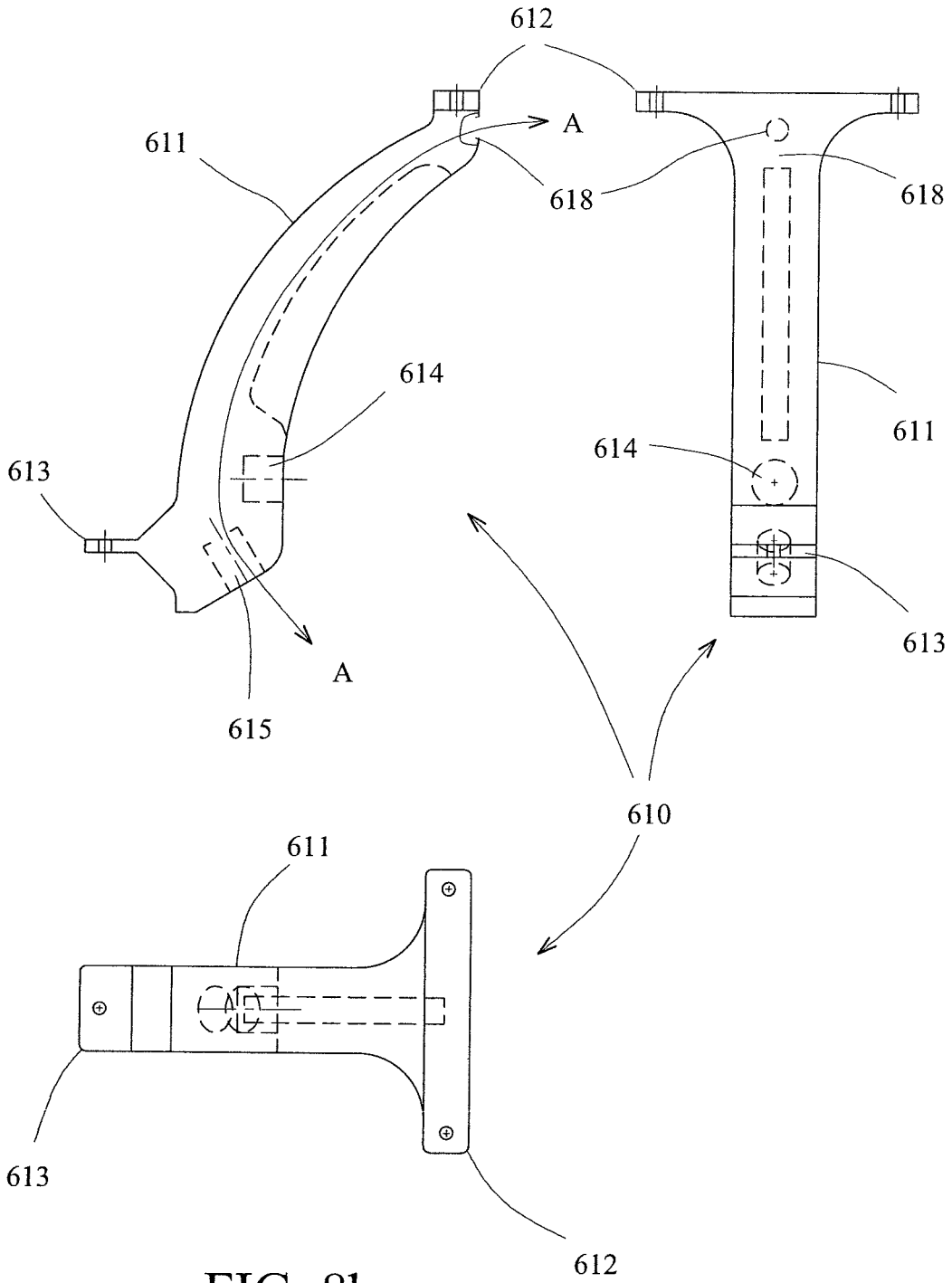
Figure 10:
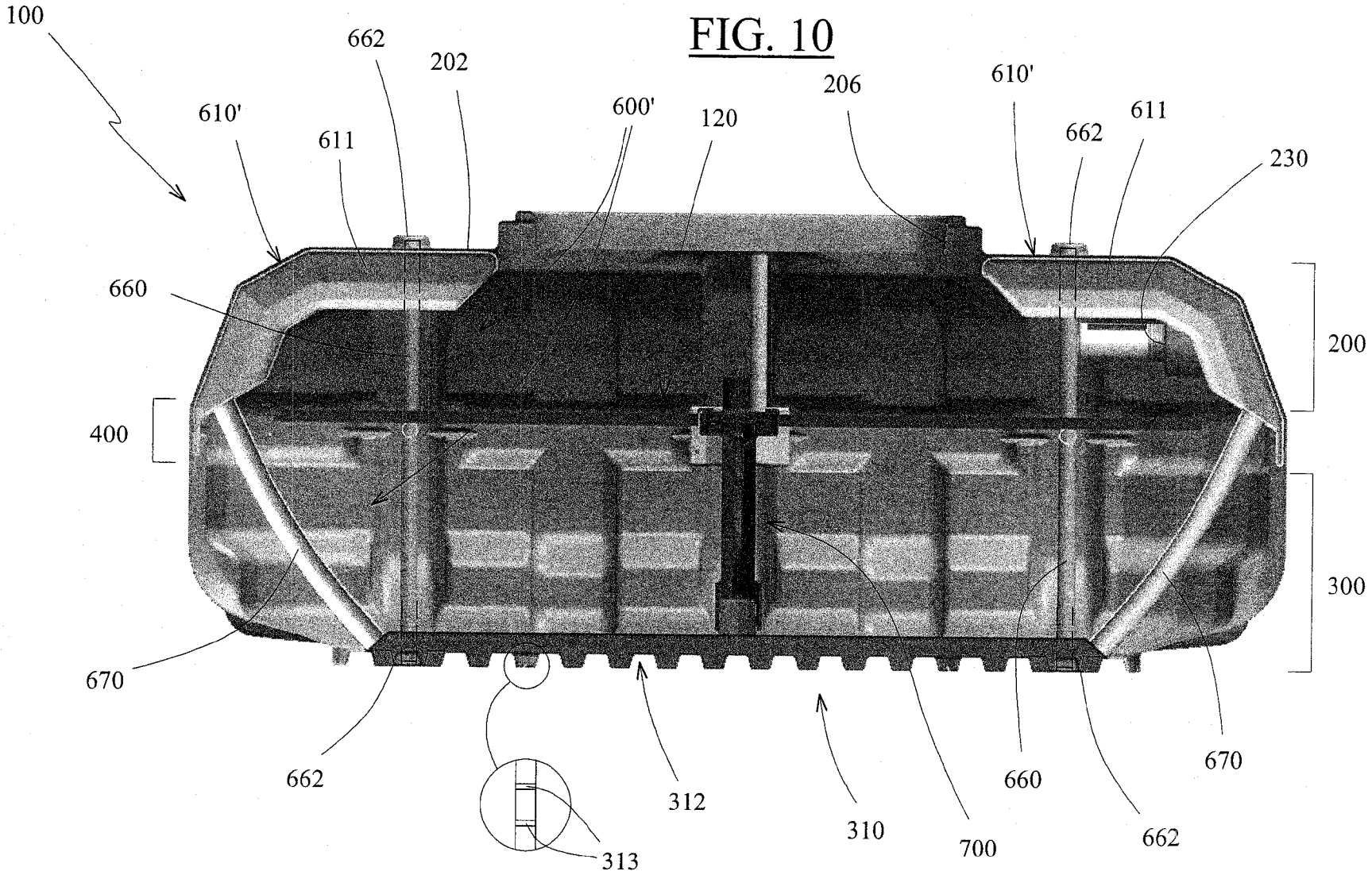
Figure 11:
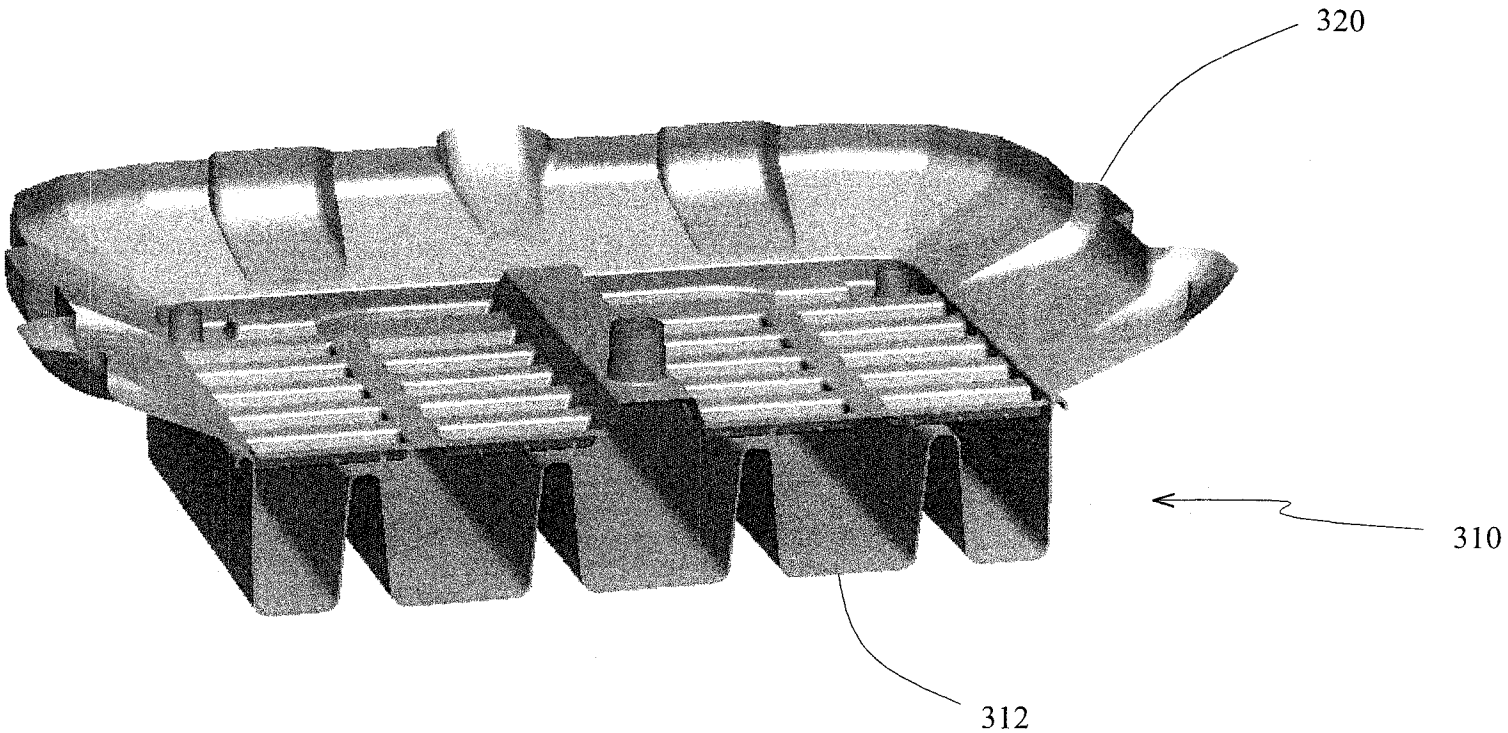
Figure 12:
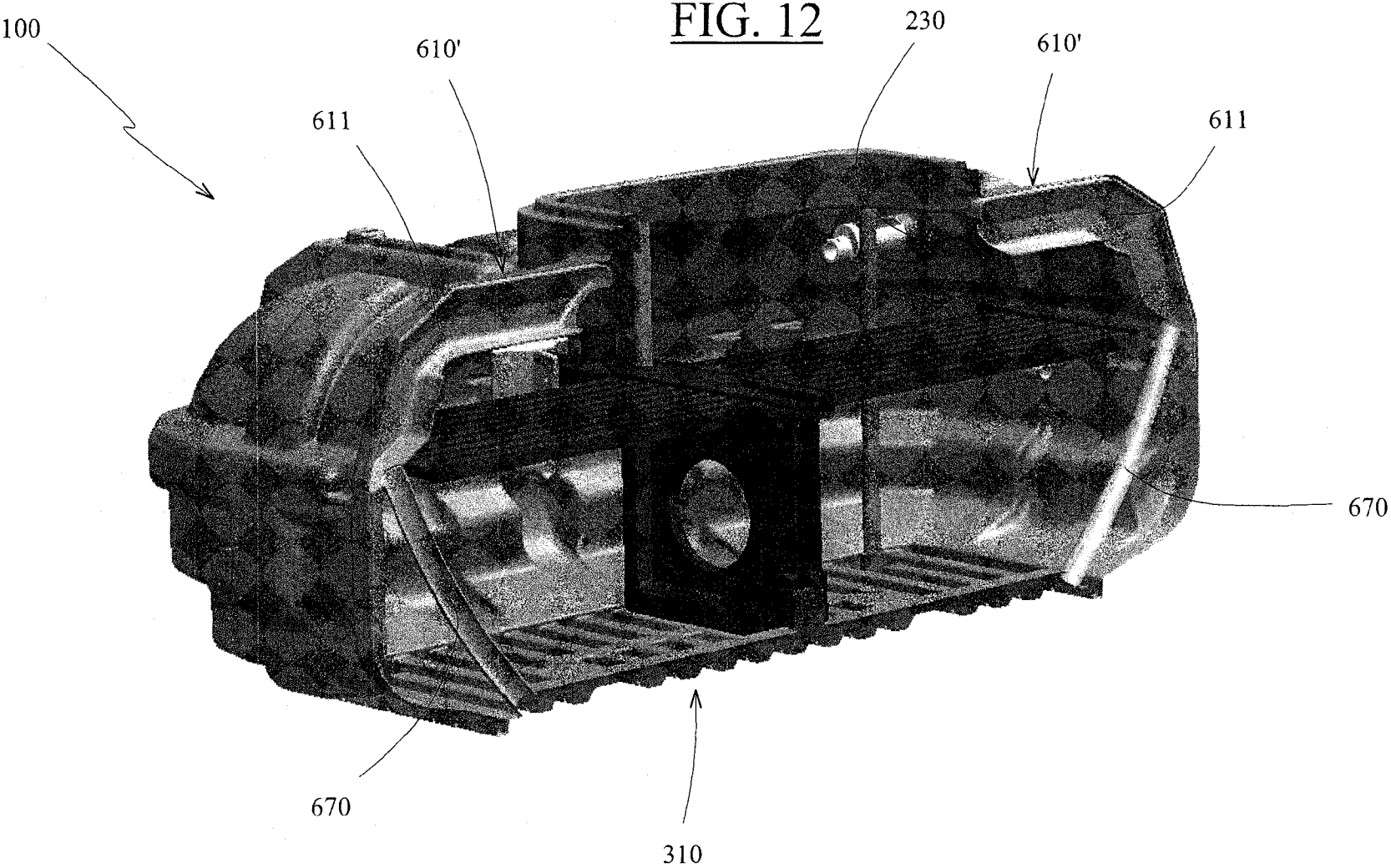
Figure 13:
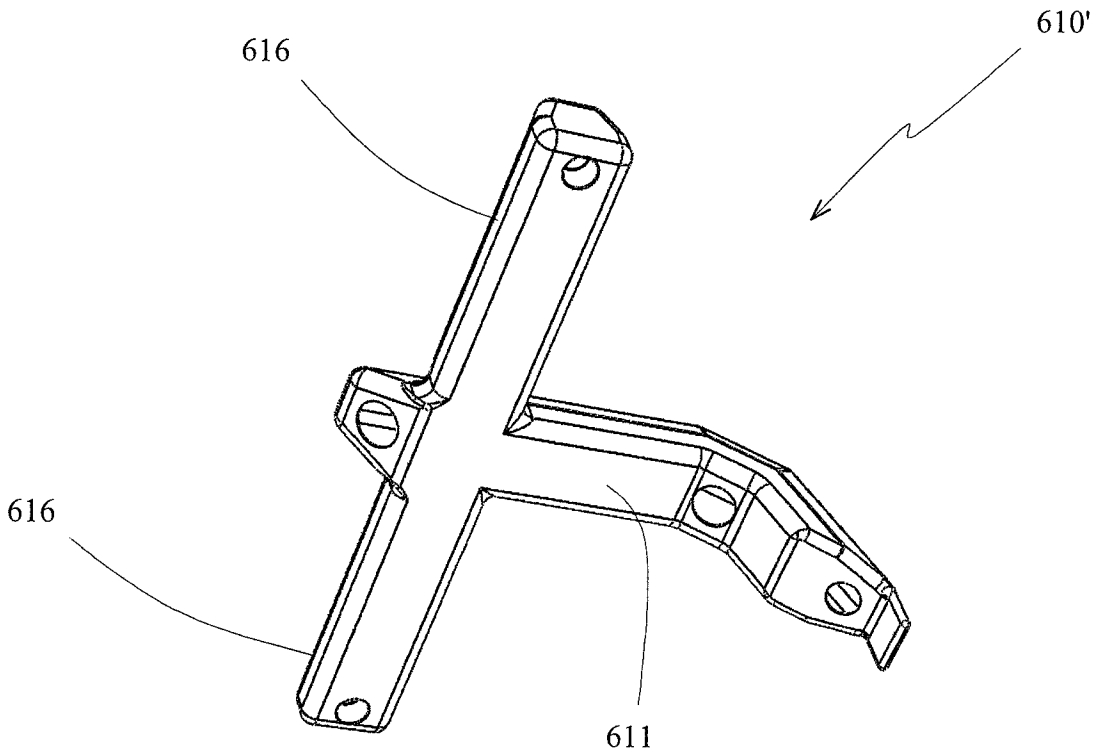
Figure 14:
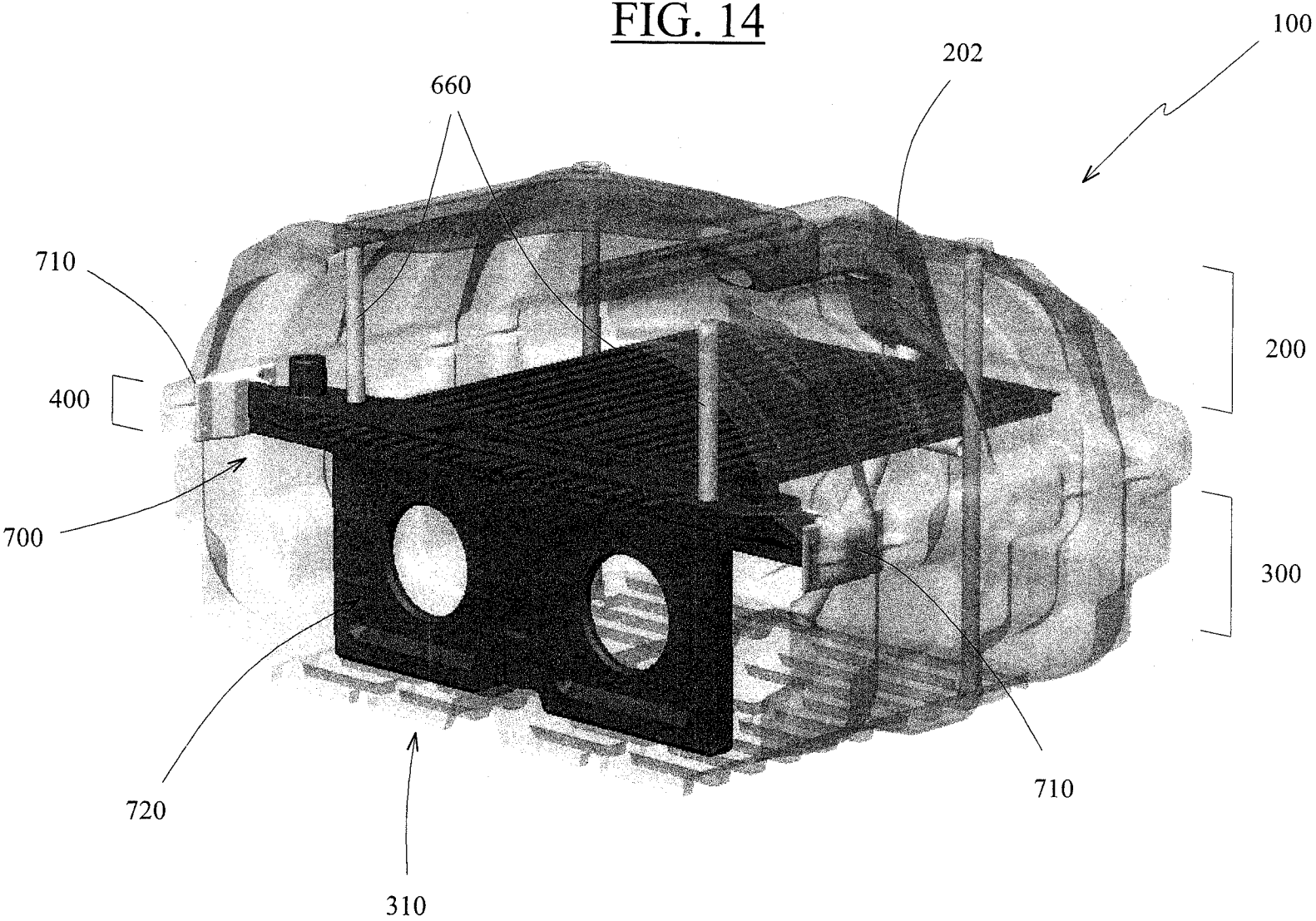
Figure 15:
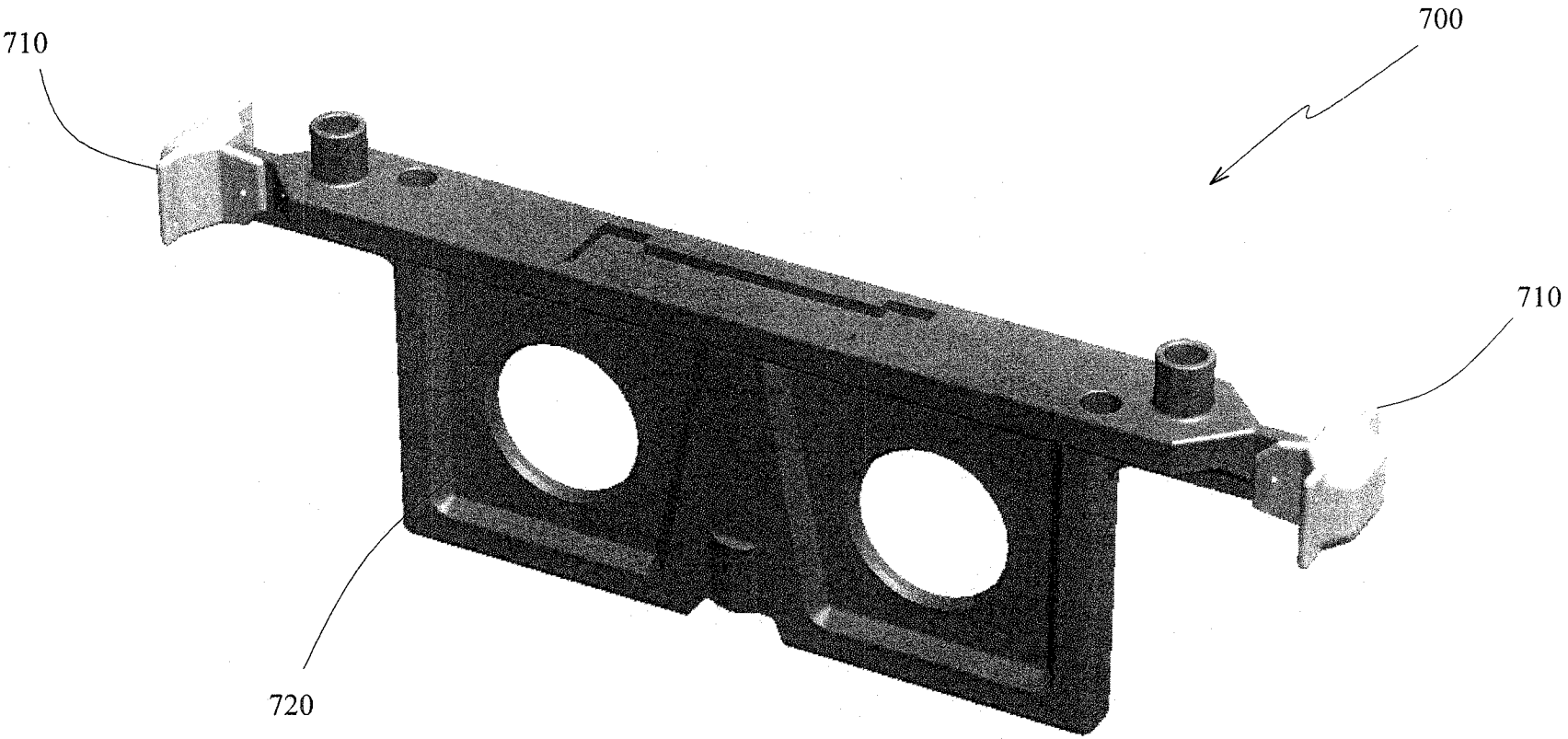

The abovementioned features of the invention, as well as others, will become more clearly apparent upon reading the following description of an example of embodiment, said description being given with reference to the appended figures, in which:

FIG. 1 shows a front view of a tank according to the invention,

FIG. 2 shows a sectional view from the front of a tank according to the invention, FIG. 3 shows a sectional view from the side of a tank according to the invention, FIG. 4 shows a sectional view of a detail of a belt for connecting between a lower part and an upper part of a tank according to the invention, FIG. 5*a* shows a front view of a floor supporting a reinforcing means for a tank according to the invention, FIG. 5*b* shows a top view of a floor supporting a reinforcing means for a tank according to the invention, FIG. 5*c* shows a side view of a floor supporting a reinforcing means for a tank according to the invention, FIG. 6*a* shows a front view of an end element of a floor for a tank according to the invention, FIG. 6*b* shows a top view of an end element of a floor for a tank according to the invention, FIG. 6*c* shows a sectional view from the side of an end element of a floor for a tank according to the invention, FIG. 7*a* shows a front view of an intermediate element of a floor for a tank according to the invention, FIG. 7*b* shows a top view of an intermediate element of a floor for a tank according to the invention, FIG. 7*c* shows a side view of an intermediate element of a floor for a tank according to the invention, FIG. 8*a* shows a front view of a voussoir for a tank according to the invention, FIG. 8*b* shows a side view of a voussoir for a tank according to the invention, FIG. 8*c* shows a back view of a voussoir for a tank according to the invention, FIG. 9*a* shows a side view of a wedge for a tank according to the invention, FIG. 9*b* shows a top view of a wedge for a tank according to the invention, FIG. 9*c* shows a front view of a wedge for a tank according to the invention, FIG. 10 shows a view in longitudinal section of a variant embodiment of a tank allowing direct infiltration of the ground by a filtered effluent according to the invention, FIG. 11 shows a perspective view of an attached bottom for a tank according to the invention, FIG. 12 shows a view in longitudinal section and in perspective of the variant embodiment of a tank according to the invention, FIG. 13 shows a perspective view of a variant embodiment of a voussoir intended to reinforce the internal structure of a tank of relatively large capacity, FIG. 14 shows a view in cross section and in perspective of a tank of FIG. 10, and FIG. 15 shows a perspective view of a beam intended to be secured in a tank according to the invention.

The tank 100 shown in FIGS. 1, 2 and 3 is intended to contain in particular wastewater in order to sanitise, purify or filter the latter.

This tank is intended to be buried so that it can be concealed and to facilitate the collection of wastewater by gravity. Only an access to the tank for the purpose of maintenance on the latter is visible once the tank has been buried.

The tank 100 thus makes it possible to collect the effluent and to treat it so that it can exit through an outlet orifice to which there is connected a pipe for transferring it for example to a spreading drain.

The casing 110 thus comprises an upper part 200 and a lower part 300 which are joined by a peripheral belt 400 located at the half-way height of the tank and intended to form a rigid connecting structure between the two parts.

The upper part 200 is composed of an upper wall 202 which is prolonged at its periphery and in the downward direction by rounded walls 204 which connect to the belt 400. An access opening 206 for access to the interior of the tank is formed in the upper wall 202. This opening 206 is able to be closed by a cover 210.

The lower part 300 is composed of a bottom 310 of parallelepiped appearance which is surmounted at its periphery by rounded walls 304 which connect to the belt 400. Beads 220 are formed in a hollowed-out manner or in relief in the wall of the upper part 200 and of the lower part 300 so as to increase the rigidity of the structure of the casing 110 of the tank 100.

In the detail view in FIG. 4, the upper part 200, the belt 400 and the lower part 300 consist of one and the same continuous wall. The belt 400 is situated outside the tank, thus forming a tank protection belt. It has a first semicircular loop 401 which prolongs the wall of the upper part 200, a short straight portion 402 which is prolonged by a second, larger semicircular loop 403, then a straight portion 404, another semicircular loop 405 and another short straight portion 406 which is prolonged by a fourth semicircular loop 407 which connects to the wall of the lower part 300. The first loop 401 and the fourth loop 407 are separate, thus forming a gap I between the two parts 200 and 300 and the purpose of which will be explained below. However, several securing bridges P locally join the two parts 200 and 300. These bridges P are located between recessed portions of the first loop 401 and of the fourth loop 407.

In FIGS. 1, 2 and 3, the bottom 310 is composed of a bottom wall 312 adjoined vertically at its periphery by side walls 314 which connect to the lower part 300. As is clearly apparent in FIG. 2, it is intended to receive a floor 500 which is provided on the one hand for supporting a filtration means (not shown) for filtering the wastewater, and on the other hand for holding a reinforcing means 600 for reinforcing the structure of the casing 110 of the tank 100.

This wastewater can enter the tank through an inlet orifice 230 located in the top part of the upper part 200 and can exit, after having passed through the filter, through an outlet orifice 330 located in the bottom 310 so as to be evacuated through a pipe to an authorised outfall.

The weight-bearing part of this floor 500 which is intended to support the filter is permeable and it is placed above the outlet orifice 330 so that the water filtered through this filter can flow through the floor and can exit from the tank through the outlet orifice 330.

The floor 500 consists of a plurality of elements 510 and 530 which rest on the bottom wall 312 and also on a peripheral edge 318 which joins the bottom 310 to the lower part 300, these elements being placed in a juxtaposed manner but without being joined.

The central part of the floor 500 forms a pit for capturing the filtered water that can flow between gaps that exist between two neighbouring elements 510, 530.

In the view of the floor 500 shown in FIGS. 2, 5*a* and 5*b*, said floor is composed of two end elements 510*a* and 510*b* and of at least one intermediate element 530 and in this case of two intermediate elements 530*a* and 530*b*.

In FIG. 6, the end element 510 is composed of a C-shaped wall 511 which locally delimits the edge of the pit, and of a bottom wall 512 which partly forms the bottom of the pit, this bottom wall 512 being joined to the wall 511 by side walls 513. Other walls 514 in the shape of a cross protrude below the element 510 so as to form a means of wedging the latter in the bottom of the tank and a means on which the floor element bears.

In FIG. 7, the intermediate element 530 is composed of two walls 531*a* and 531*b* arranged on each side of the intermediate element 530 which locally delimit the edge of the pit, and of a bottom wall 532 which partly forms the bottom of the pit, this bottom wall 532 being joined to the walls 531*a*, 531*b* by side walls 533. Other walls 534 in the shape of a cross protrude below the element 530 so as to form a means of wedging the latter in the bottom of the tank and a means on which the floor element bears.

In FIG. 3, the means of wedging the elements 510 and 530 cooperate with corresponding indents 316 formed in the bottom wall 312 of the casing 110 so as to laterally wedge the elements when they are juxtaposed and so as to separate them, and on which said elements also rest.

The reinforcing means 600 is designed to be secured on the one hand to the floor 500 and to be secured on the other hand to the upper part and the lower part in order to make the structure of the casing more rigid so that it can withstand the pressure exerted by the surrounding material when the tank is buried and is not filled or is filled only a little.

The reinforcing means 600 is composed of voussoirs 610, wedges 630 and connecting bars 650 placed between these elements or between these elements and the floor 500.

The voussoirs 610 are intended to bear against rounded walls 204 and to be secured in the gaps I which exist between the upper part 200 and the lower part 300 so as to absorb and transfer the forces likely to be exerted externally on the upper part 200 and on the belt 400 of the casing 110 of the tank 100.

In FIG. 8, the voussoir 610 comprises a wall 611 in the shape of an arch portion capable of mating internally with a rounded wall of the upper part. This wall is surmounted by a wall in the shape of a plate 612, the large length of which is arranged perpendicular to the median plane of the wall 611 so as to support locally the rim of the access opening of the tank. Opposite the plate 612, the wall 611 is prolonged in its dorsal part by a lug 613 of small thickness able to be inserted in the gap provided between the upper part and the lower part of the casing of the tank.

A first housing 614 is formed in the wall 611, through its inner face, facing horizontally in FIG. 8*a*, so as to receive an end of a connecting bar capable of securing the voussoir to another one arranged opposite it. In FIG. 5*b*, four voussoirs 610 are thus joined in pairs by respectively two bars 650*a*.

In FIG. 8, a second housing 615 is formed in the wall 611, through its inner face, facing downwards in FIG. 8*a*, so as to receive an end of a connecting bar capable of securing the voussoir to a floor element. In FIGS. 5*a* and 5*c*, each voussoir 610 is joined to an intermediate element 530 by a bar 650*b*.

In FIG. 7, this intermediate element 530 is provided on its two side walls 533 with respectively two bosses 535 in which there are formed two housings 536 for receiving the ends of two connecting bars 650*b*.

In FIG. 3, the pressure likely to be exerted by the surrounding material on the upper part 200 is absorbed by each voussoir 610 so as to be transferred to another voussoir placed opposite or so as to be transferred to the bottom 310 of the casing 110 of the tank 100 via the floor 500 so as to avoid any weakening of said casing under the load.

The wedges 630 are intended to be secured in the gaps I that exist between the upper part 200 and the lower part 300 so as to absorb and transfer the forces likely to be exerted on the upper part 200 and the belt 400 of the casing 110 of the tank 100.

In FIG. 9, the wedge 630 consists of a block delimited on one side by two lateral facets 631*a* and 631*b* and one bottom facet 632 which is intended to face downwards, and delimited on the other side by a lug 633 of small thickness able to be inserted in the gap provided between the upper part and the lower part of the casing of the tank.

The two side facets 631*a* and 631*b* form between them an angle of approximately 90°. Two housings 634*a*, 634*b* are formed respectively in two lateral facets 631*a* and 631*b* so as to receive an end of a connecting bar capable of securing the wedge to two obliquely arranged voussoirs. In FIGS. 5*b* and 5*c*, each wedge 630 is joined to two voussoirs 610 by respectively two bars 650*c*.

In FIG. 9, a third housing 635 is formed in the bottom facet 632 so as to receive a connecting bar capable of securing the wedge to a floor element. In FIG. 5, each wedge 630 is joined to an end element 510 by a bar 650*d*.

In FIG. 6, this end element 510 is provided on its bottom wall 512 with a boss 515 in which there is formed a housing 516 for receiving the end of a connecting bar 650*d*.

In FIG. 3, the pressure likely to be exerted by the surrounding material on the upper part 200 and on the belt 400 is absorbed by each voussoir 610 and by each wedge 630 so as to be transferred to another voussoir or another wedge or so as to be transferred to the bottom 310 of the casing 110 of the tank 100 via the floor 500 so as to avoid any weakening of the casing 110 under the load.

It will be noted that, in FIGS. 7 and 8 respectively, the housings 536 formed in the floor element 530 and the housing 615 formed in the voussoir 610 open outwards and that vents 538 and 618 which open outwards are formed in the wall of these hollow components, thus opening up a passage through these elements which allows air to circulate as shown by the arrows A. Furthermore, the corresponding connecting bars 650 are hollow so that, as can be seen in FIG. 3, it is possible to ventilate the part located below the floor in order to promote, with the volume of air contained in the tank, by supplying oxygen, the functioning of the tank 100.

In FIG. 7*a*, the vent 538 opens outwards below the walls 531.

In FIG. 8*a*, the vent 618 formed in the voussoir 610 opens outwards below the fixing plate 612, that is to say in its top part, so that its opening is located above the maximum level of liquid that can be contained in the tank, so as to avoid the formation of a siphon.

In one variant embodiment, the ventilation of the part located below the floor is also carried out through connecting bars supporting the wedges and through connecting bars connecting the wedges to the voussoirs. In FIG. 8*a*, the floor element 510 is to this end provided with a corresponding vent 518 which opens outwards.

In FIG. 9, the three housings 634*a*, 634*b* and 635 formed in the wedge 630 open outwards, allowing communication between them.

In FIG. 2, the arrows A show that the air can circulate between the voussoirs 610 and the four floor elements 540*a*, 530*a*, 530*b* and 510*b*.

The elements constituting the floor 500 and the reinforcing means 600 are introduced into the tank through the access opening 206. In a first phase, the floor 500 is constructed by arranging the elements 510 and 530 side by side on the bottom wall 312.

In a second phase, the voussoirs 610 and the wedges 630 are put in place so that the lugs 613 and 633 are introduced into the gap I and between two bridges P so as to wedge them laterally. The connecting bars 650 are fixed between the floor elements 510, 530 and the voussoirs 610 and the wedges 630, between the voussoirs 610, and between the wedges 630 and the voussoirs 610. In order to house the ends of some bars, this operation may be assisted by using rams to provisionally move apart the walls of the casing 110.

In a third phase, securing by bolting takes place of the elements 510, 530 to the bottom 310, the lugs 613, 633 held in the gap I between bridges P, and the plates 612 of the voussoirs 610 at the periphery of the access opening 206.

The tank of the invention does not deform once it has been buried when it is not filled or is incompletely filled.

The reinforcing means 600 behaves as a shoring internal to the tank in order to reinforce the structure thereof so that it withstands a pressure likely to be applied externally thereto.

It also prevents the casing 110 from weakening under the load.

The belt 400 protects the casing 110 at the join between its upper part 200 and its lower part 300. It also reinforces the structure of the casing.

The constituents of the tank 100, of the floor 500 and of the reinforcing means 600 are advantageously made from polyethylene by a rotational moulding method which makes it possible to obtain hollow parts of relatively large dimensions. The tank 100, that is to say the upper part 200, the lower part 300 and the belt 400, are made in a single piece, this being the only valid solution for obtaining a perfectly leaktight tank.

The elements 510 and 530 of the floor 500 can be manufactured by the rotational moulding method by using a starting material capable of forming a polyethylene foam in order to increase their rigidity.

The tank of the invention can be delivered ready for use.

In a variant embodiment shown in FIG. 10, the tank 100 is intended to infiltrate the ground directly with the filtered effluent. The tank in this case has no floor and its bottom 310 includes a bottom wall 312 which is perforated by a plurality of passages 313 so as to enable the effluent to infiltrate, by gravity, directly the ground on which the tank rests. The bottom wall 312 has to this end a crenulated section and slots 313 are formed transversely in the lowest facets of the crenulated section.

In FIG. 11, a pit 320 is attached to the bottom 310 of the tank 100 for example by a welding operation in order to collect the filtered effluent. This pit 320 is used in a tank provided with an outlet orifice, when an infiltration tank cannot be used.

A filtration grille may cover the bottom of this pit or the bottom of the tank in order to prevent the filtration means from leaving the tank.

In FIG. 10 and in order to enable the tank to be transported when it is filled, the reinforcing means 600' incorporates a connection means 660 for connecting between the upper wall 202 of the tank and its bottom 310. This connection means advantageously consists of posts 660 secured by their ends in housings 662 formed in the upper wall 202 and in the bottom 310. During transport of the tank, and when it is lifted by its upper wall, the posts 660 work in extension and retain the bottom 310. When the tank is buried, the posts 660 work in compression by transferring the load supported by the upper part 200 of the tank to its bottom 310.

The reinforcing means 600' also comprises voussoirs 610' having a structure different from that of the first embodiment of the tank, which voussoirs support its upper part 200 by being embedded partially in reinforcements of this upper part 200 and by bearing on the one hand against the rim of the access opening 206 and on the other hand, at the level of the belt 400 and by their other edge, on tubes 670. The lower ends of these tubes bear against the bottom 310 of the tank 100. Each voussoir 610' comprises a wall 611 in the shape of an arch portion capable of mating internally with a rounded wall of the upper part. It also has no lug. The combination of each voussoir and its corresponding tube reinforces the end structures of the tank.

In FIG. 12, each voussoir 610' and its corresponding tube 670 are hollow and are provided with vents, thus providing a passage through these elements which enables air to circulate in the tank 100.

In a variant embodiment shown in FIG. 13, the voussoir 610' has when seen from below a T-shaped cross section including two rectilinear profiles 616 butted against the wall in the shape of an arch portion 611. When a voussoir 610' is mounted in the tank, the two rectilinear profiles 616 bear laterally against the upper wall of the tank in order to support it.

In FIG. 14, the reinforcing means 600' also comprises a beam 700 secured to two opposite sides of the tank at the level of the belt 400. By being joined to two sides of the tank, this beam reinforces the structure of the latter.

In FIG. 15, the beam 700 is respectively provided at its two ends with two end pieces 710 capable of being secured in the belt of the tank. The beam 700 also comprises a plate 720 which protrudes downwards so as to be able to bear against the bottom of the tank in order to reinforce the structure thereof and to delimit two compartments in which two volumes of the filtration means are placed.

The beam may also support a tilting trough (not shown) capable of alternately pouring a constant quantity of effluent into one or the other compartment.

Returning to FIG. 14, posts 660 protrude from the beam 700, in a direction opposite to the plate 720, and the free ends of which are fixed to the upper wall 202 of the tank so that the beam can join this upper wall 202 and the bottom 310 of the tank in order to make the latter more rigid in the median plane in which the beam is installed. The plate 720 is perforated so as to limit the quantity of material necessary for the manufacture thereof and so that the two compartments can communicate.

It will be noted in FIG. 10 that this beam 700 also makes it possible to support the elements of a possible means 120 of distributing the effluent across the filtration means.

The reinforcing means 600' of this variant embodiment of the infiltration tank may in one embodiment (not shown) be used on the tank provided with an outlet orifice, and vice versa.

The use of the two types of tanks of the invention refers to a use buried in the ground. Where appropriate, they may be used by being placed on the ground for specific applications.

The invention claimed is:

1. A tank (100) configured to contain a liquid, the tank (100) comprising: a casing (110) having an upper part (200) and a lower part (300), the tank being provided internally with a means for reinforcing a structure of the casing (110) so that it can withstand a pressure exerted by a surrounding material when the tank (100) is buried and is not completely filled, characterised in that the reinforcing means (600, 600') comprises voussoirs (610, 610') bearing against the upper part (200) and in that the tank (100) incorporates bars (650*d*) for absorbing supporting forces of the voussoirs (610, 610') so as to transfer said supporting forces onto a bottom (310) of said tank wherein the tank (100) further includes a gap (I) which separates the upper part (200) and the lower part (300), the reinforcing means (600) further comprising wedges (630), the voussoirs (610) and the wedges (630) being provided respectively with lugs (613, 633) which are inserted in the gap (I), at least some of the voussoirs (610) and wedges (630) being connected via connecting bars (650*a*, 650*c*).

2. Tank (100) according to claim 1, characterised in that each voussoir (610, 610') comprises a wall (611) in the shape of an arch portion capable of mating internally with a rounded wall (204) of the upper part (200).

3. Tank (100) according to claim 2, characterised in that each voussoir (610') comprises two rectilinear profiles (616) butted against the wall in the shape of an arch portion (611).

4. Tank (100) according to claim 1, characterised in that it comprises in its bottom (310) a permeable floor (500) intended to support a means for filtering the liquid that may be introduced into said tank, the floor (500) being connected to the voussoirs (610) and to the wedges (630) via connecting bars (650).

5. Tank (100) according to claim 4, characterised in that the floor (500) is composed of a plurality of elements (510 and 530) placed in a juxtaposed manner on the bottom (310) and separate therefrom.

6. Tank (100) according to claim 5, characterised in that the floor (500) comprises two end elements (510) placed one on each side of at least one intermediate element (530), the end element (510) being provided with a boss (515) in which there is formed a first housing (516) for receiving the end of a connecting bar (650*d*), the intermediate element (530) being provided respectively with two bosses (535) in which there are formed two receiver housings (536) for receiving the ends of two connecting bars (650*b*).

7. Tank (100) according to claim 6, characterised in that each of the two receiver housings (536) are formed in a floor element (530) and a second housing (615) formed in the voussoir (610) are connected respectively to vents (538 and 618) which open outwards, the corresponding connecting bars (650) being hollow so that the part located below the floor can be ventilated.

8. Tank (100) according to claim 7, characterised in that the housing (516) formed in the floor element (510) is connected to a vent (518) which opens outwards, and in that the connecting bar (650*d*) between the floor element (510) and the wedge (630) and the connecting bars (650*c*) between the wedge (630) and the voussoir (610) are hollow, the housings (634*a*, 634*b*, 635) formed in the wedge (630) opening outwards.

9. Tank (100) according to claim 5, characterised in that the floor elements (510, 530), the voussoirs (610), the wedges (630) and the connecting bars (650) are made by a rotational moulding method.

10. Tank (100) according to claim 9, characterised in that the rotational moulding method uses a starting material capable of forming a polyethylene foam.

11. Tank (100) according to claim 1, characterised in that the wall (611) in the shape of an arch portion is surmounted by a wall in the shape of a plate (612), the plate having a large length of which is arranged perpendicular to a median plane of the wall (611) so as to support locally the rim of an access opening (206) of the tank (100), the wall (611) being prolonged, opposite the plate (612) and in its dorsal part, by a lug (613) able to be inserted in the gap (I) provided between the upper part (200) and the lower part (300) of the casing (110), a first housing (614) being formed in the wall (611), through its inner face, facing horizontally, so as to receive an end of a connecting bar (650*a*), a second housing (615) being formed in the wall (611), through its inner face, facing downwards, so as to receive an end of another connecting bar (650*b*).

12. Tank (100) according to claim 1, characterised in that each wedge (630) consists of a block delimited on one side by two lateral facets (631*a*, 631*b*) and one bottom facet (632) which is intended to face downwards, and delimited on another side by a lug (633) able to be inserted in the gap (I) provided between the upper part (200) and the lower part (300) of the casing (110), two housings (634*a*, 634*b*) being formed respectively in the two lateral facets (631*a* and 631*b*) so as to receive an end of a connecting bar (650*c*), a third housing (635) being formed in the bottom facet (632) so as to receive an end of a third connecting bar (650*d*).

13. Tank (100) according to claim 1, characterised in that bridges (P) are formed locally in the gap (I) between the upper part (200) and the lower part (300) so as to reinforce the connection thereof and to laterally wedge the voussoirs (610) and the wedges (630).

14. Tank (100) according to claim 1, characterised in that it is provided with an external peripheral belt (400) intended to form a rigid connecting structure between the two parts (200, 300).

15. Tank (100) according to claim 14, characterised in that the upper part (200), the lower part (300) and the belt (400) consist of one and the same continuous wall.

16. Tank (100) according to claim 14 or 15, characterised in that the belt (400) is composed of a first semicircular loop (401) which prolongs the wall of the upper part (200), a short straight portion (402) which is prolonged by a second, larger semicircular loop (403), a straight portion (404), another semicircular loop (405), another short straight portion (406) which is prolonged by a fourth semicircular loop (407) which is connected to the wall of the lower part (300), the first loop (401) and the fourth loop (407) being separate so as to form the gap (I) between the two parts (200, 300).

17. Tank (100) according to claim 1, characterised in that the reinforcing means (600') comprises posts (660) secured by their ends in housings (662) respectively formed in the upper wall (202) of the tank (100) and in its bottom (310).

18. Tank (100) according to claim 17, characterised in that the reinforcing means (600') comprises a beam (700) secured to two opposite sides of the tank.

19. Tank (100) according to claim 18, characterised in that a plate (720) protrudes downwards so as to be able to bear against the bottom (310) of the tank in order to reinforce the structure thereof and to delimit two compartments in which two volumes of the filtration means can be placed, posts (660) protrude from the beam (700) in a direction opposite to the plate (720) and the free ends of which are fixed to the upper wall (202) so that the beam (700) can join the upper wall (202) and the bottom (310) of the tank (100) in order to make the latter more rigid.

20. Tank (100) according to claim 1, characterised in that it is provided with an outlet orifice (330) intended for evacuating a treated effluent to an authorised outfall.

21. Tank (100) according to claim 1, characterised in that the bottom (310) is perforated by a plurality of passages (313) so as to enable an effluent to infiltrate, by gravity, into ground on which the tank rests.

22. Tank (100) according to claim 21, characterised in that the bottom (310) consists of a component attached to the tank.

23. Tank (100) according to claim 1, characterised in that the casing (110) is made by a rotational moulding method.

24. Tank (100) according to claim 1, characterised in that each voussoir (610, 610') comprises a wall (611) in the shape of an arch portion capable of mating internally with a rounded wall (204) of the upper part (200) and in that the tank (100) incorporates tubes (670) for absorbing supporting forces of the voussoirs (610, 610') so as to transfer said supporting forces onto a bottom (310) of said tank.

* * * * *